US009282854B2

(12) United States Patent
Kuo

(10) Patent No.: US 9,282,854 B2
(45) Date of Patent: Mar. 15, 2016

(54) BATHROOM CARRYING DEVICE AND BATHROOM HANGING ASSEMBLY HAVING THE SAME

(71) Applicant: Anthony Kuo, Taichung (TW)

(72) Inventor: Anthony Kuo, Taichung (TW)

(73) Assignee: Hacksaw & Knife Manufactory Co., Ltd., Taichung (TW)

( * ) Notice: Subject to any disclaimer, the term of this patent is extended or adjusted under 35 U.S.C. 154(b) by 114 days.

(21) Appl. No.: 14/146,610

(22) Filed: Jan. 2, 2014

(65) Prior Publication Data

US 2015/0182025 A1 Jul. 2, 2015

(51) Int. Cl.
*A47G 29/087* (2006.01)
*A47K 10/10* (2006.01)

(52) U.S. Cl.
CPC ..... *A47K 10/10* (2013.01); *A47K 2201/02* (2013.01)

(58) Field of Classification Search
CPC .... A47B 96/06; A47B 96/061; A47B 96/062; A47B 96/063; A47B 96/066; A47K 10/10; A47K 2201/02
USPC ..... 211/16, 119.009
See application file for complete search history.

(56) References Cited

U.S. PATENT DOCUMENTS

| | | | | | |
|---|---|---|---|---|---|
| 1,893,729 | A * | 1/1933 | Call | 248/222.14 |
| 2,330,591 | A * | 9/1943 | Kendall | 248/222.14 |
| 3,338,602 | A * | 8/1967 | Arnd | 403/252 |
| 4,104,000 | A * | 8/1978 | Fleischmann | 403/7 |
| 5,058,845 | A * | 10/1991 | Itagaki | 248/346.04 |
| 6,095,713 | A * | 8/2000 | Doyle et al. | 403/97 |
| 6,244,549 | B1 * | 6/2001 | Ching | 248/222.14 |
| 6,591,762 | B1 * | 7/2003 | Haghayegh | 108/42 |
| 6,942,190 | B1 * | 9/2005 | Lu | 248/309.3 |
| D520,787 | S * | 5/2006 | Ferrer Beltran | D6/523 |
| 7,926,772 | B2 * | 4/2011 | Lowe et al. | 248/222.14 |
| 8,382,051 | B2 * | 2/2013 | Smith | 248/221.11 |
| 8,671,545 | B1 * | 3/2014 | Zimmerman | 29/525.01 |
| 2006/0175496 | A1 * | 8/2006 | Lai | 248/251 |
| 2011/0248134 | A1 * | 10/2011 | Goad | 248/222.14 |

* cited by examiner

*Primary Examiner* — Korie H Chan
(74) *Attorney, Agent, or Firm* — Muncy, Geissler, Olds & Lowe, P.C.

(57) ABSTRACT

A bathroom carrying device and a bathroom hanging assembly having the same is provided, including a metal shell member, a plastic member and a carrying member. The metal shell member is formed with an interior space and an open end, and a through hole is provided for communicating the interior space and outside. The open end is provided for mounting of a mounting assembly for being fixedly attached to a base. The plastic member is disposed in the interior space and has at least one inserting hole corresponding to the at least one through hole. The carrying member has at least one disposing end and a carrying portion, and the at least one disposing end is disposed through the at least one through hole and into the at least one inserting hole. The carrying portion is disposed outside of the metal shell member.

18 Claims, 11 Drawing Sheets

BATHROOM CARRYING DEVICE AND BATHROOM HANGING ASSEMBLY HAVING THE SAME

BACKGROUND OF THE INVENTION

1. Field of the Invention

The present invention relates to a bathroom device, more particularly, to a bathroom carrying device and a bathroom hanging assembly having the same.

2. Description of the Prior Art

Usually, bathroom brackets are mounted in bathrooms for people to hang towels and clothes or place soap, body wash, shampoo and others. In view of anti-humidity, stability and structural strength, most of the brackets are made of metal. Among the conventional brackets, the most common structure is that two metal connecting bases are firstly fixedly disposed on the wall of a bathroom, and then a placing shelf with one or a plurality of rods or hanging parts is fixedly connected with the two metal connecting bases. However, the two metal connecting bases are usually manufactured by a solid metal body formed with mounting holes which are formed by drilling, in which the mounting holes are provided for insertion of rods or hanging parts; therefore, it is material-wasting, high-cost, heavy and difficult to process.

Another kind of conventional bathroom bracket structure is that rods or hanging parts are welded and fixedly connected with a metal connecting base, the metal connecting base is further formed with a screwing hole for a screw to be disposed therethrough, and then the bathroom bracket is fixedly screwed onto the wall of the bathroom. This kind of conventional structure has the same disadvantages as the above-mentioned structure.

The structures of the conventional bathroom bracket disclosed in TWM314024, TWM293740 and TWM249609, wherein a mounting plate a first tubular body is integrally connected, the mounting plate is provided for being fixedly screwed onto the wall of the bathroom, and at least one second tubular body is mounted between the two tubular bodies; however, the first tubular body and the mounting plate are integrally connected and undetachable, so it is unable to meet various requirements and change according to different environmental conditions.

The present invention is, therefore, arisen to obviate or at least mitigate the above-mentioned disadvantages.

SUMMARY OF THE INVENTION

The main object of the present invention is to provide a bathroom carrying device and a bathroom hanging assembly having the same for hanging, placing, disposing or receiving an object. The structure of the present invention has stable structure and good structural strength. Furthermore, it has simple structure and low weight, and is easy to be manufactured and processed. It is low-cost and easy to be dismounted and mounted into different combination types.

To achieve the above and other objects, the present invention provides a bathroom carrying device, including a metal shell member, a plastic member and a carrying member. The metal shell member is surroundingly formed with an interior space and has an open end, and at least one through hole is provided for communicating the interior space and outside. The open end is provided for mounting of a mounting assembly which is provided for being fixedly attached to a base. The plastic member is disposed in the interior space and has at least one inserting hole, and the at least one inserting hole corresponds to the at least one through hole. The carrying member has at least one disposing end and a carrying portion, and the at least one disposing end is disposed through the at least one through hole and into the at least one inserting hole. The carrying portion is outside of the metal shell member and provided for carrying an object.

To achieve the above and other objects, the present invention further provides a bathroom hanging assembly, including at least one above-mentioned bathroom carrying device, and further including at least one mounting assembly mounted at a corresponding open end of a metal shell member for being fixedly attached to a base.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
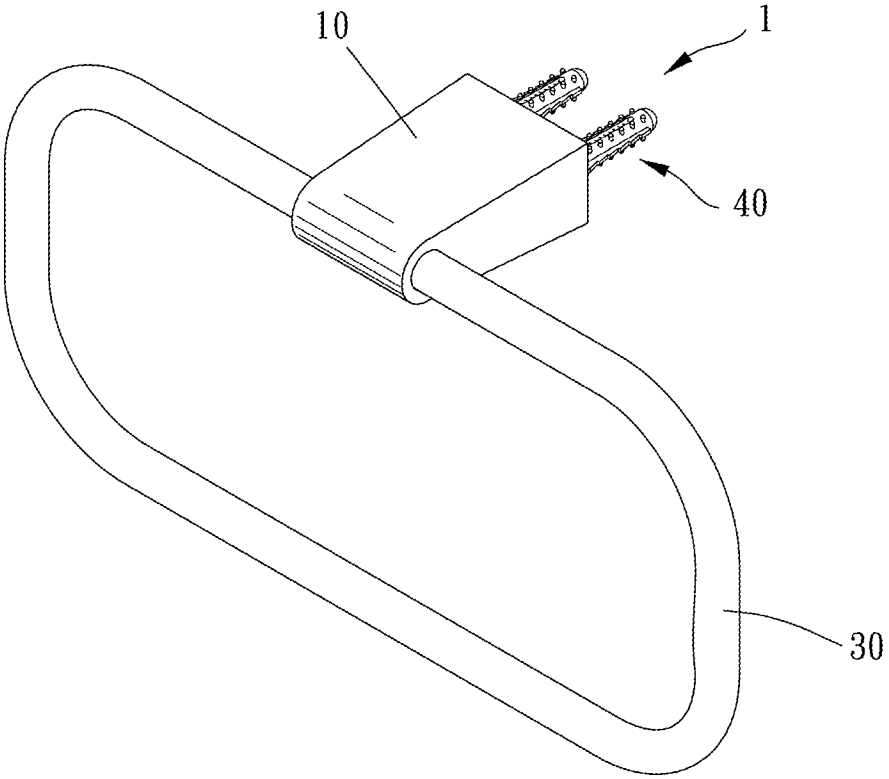
FIG. 1 is a stereogram of a first preferred embodiment of the present invention.
Figure 2:
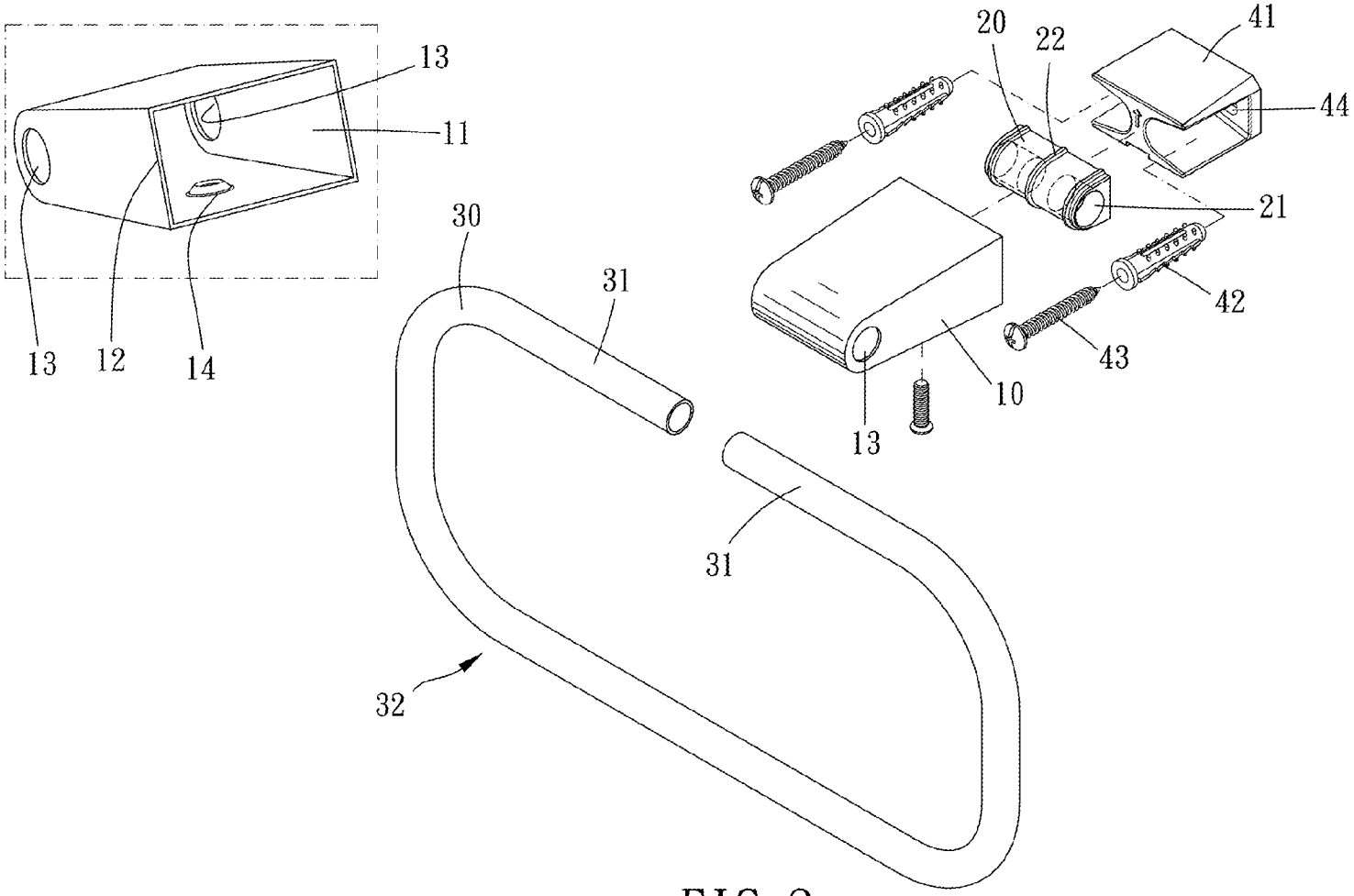
FIG. 2 is a breakdown drawing of the first preferred embodiment of the present invention.
Figure 3:
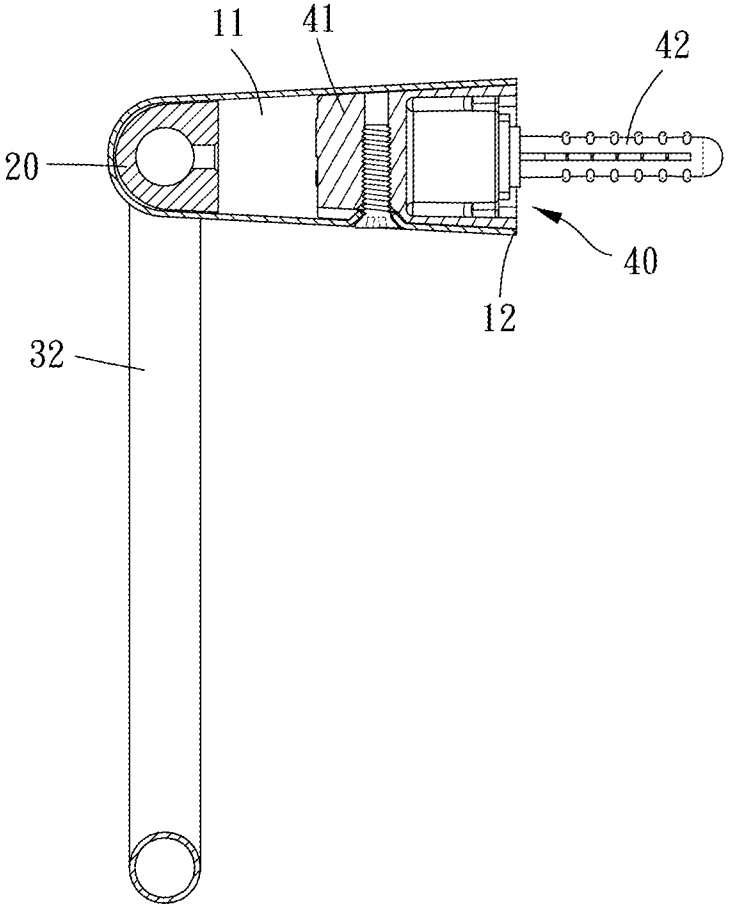
FIG. 3 is a cross-sectional view of the first preferred embodiment of the present invention.

Please refer to FIGS. 1 to 3 for a first preferred embodiment of the present invention. A bathroom carrying device 1 includes a metal shell member 10, a plastic member 20 and a carrying member 30.

The metal shell member 10 is surroundingly formed with an interior space 11 and has an open end 12, and at least one through hole 13 is disposed thereon for communicating the interior space 11 and outside. The open end 12 is provided for mounting of a mounting assembly 40 which is provided for being fixed attached to a base (for example, walls of bathrooms or objects which can be stably connected with, not shown). In this embodiment, the mounting assembly 40 includes an inserting member 41, two wall bolts 42 and two screw members 43. The cross-section outline of the inserting member 41 can closely cooperates with the outline of the open end 12, and the inserting member 41 is provided with two mounting holes 44. The two screw members 43 go through the two mounting holes 44 from inside to outside so as to be stably attached to the base. The metal shell member 10 is closely disposed around the inserting member 41 with the open end 12, and preferably, the metal shell member 10 is further formed with at least one disposing hole 14 on the position corresponding to the mounting assembly 40. A fixing member such as screw can be disposed through the disposing hole 14 to stably screw the mounting assembly 40 and the metal shell member 10 together. In this embodiment, the metal shell member 10 is formed with the two through holes 13 facing each other, and each through hole is a round hole. The interior space 11 is tapered from the open end 12 toward an opposite end.

The plastic member 20 is disposed in the interior space 11 and has at least one inserting hole 21, and the at least one inserting hole 21 corresponds to the at least one through hole 13. In this embodiment, the plastic member 20 has the two inserting holes 21, and each inserting hole is a round hole. Preferably, the shape of the plastic member 20 cooperates with that of the interior space 11. More preferably, the plastic member 20 is deformably and restrictedly abutted against the metal shell member 10; thereby, the plastic member 20 can be stably disposed in the metal shell member 10. Specifically, preferably, the surface of the plastic member 20 is formed with a plurality of protruding ribs 22, and the protruding ribs 22 can be engageably abutted against the metal shell member 10; therefore, the plastic member 20 can be stably disposed in the metal shell member 10. Furthermore, when a possible tolerance between the metal shell member 10 and the plastic member 20 is produced due to manufacturing or other factors, the protruding ribs 22 can be appropriately deformed for allowing the metal shell member 10 and the plastic member 20 to be effectively abutted against each other. In addition, the resistance will not become larger because the metal shell member 10 and the plastic member 20 are contacted in a wide area; hence, it is easy and fast to mount and dismount.

The carrying member 30 has at least one disposing end 31 and a carrying portion 32, and the at least one disposing end 31 is disposed through the at least one through hole 13 and into the at least one inserting hole 21. The carrying portion 32 is provided outside of the metal shell member 10 for carrying an object. Preferably, the shape of the at least one disposing end 31 cooperates with that of the at least one inserting hole 21. Thereby, the design of the disposing end 31 and the inserting hole 21 can be changed in accordance with various requirements, for example, the disposing end 31 can be designed as rotatable or non-rotatable relative to the inserting hole 21. In this embodiment, the carrying member 30 is substantially C-shaped and has the two disposing ends 31 facing each other. Each disposing end 31 is in column shape, and each disposing end 31 is disposed through corresponding round through hole 13 and into corresponding round inserting hole 21; therefore, a close annular hanging space is formed for people to hang towels, clothes or other appropriate bathroom products.

Figure 4:
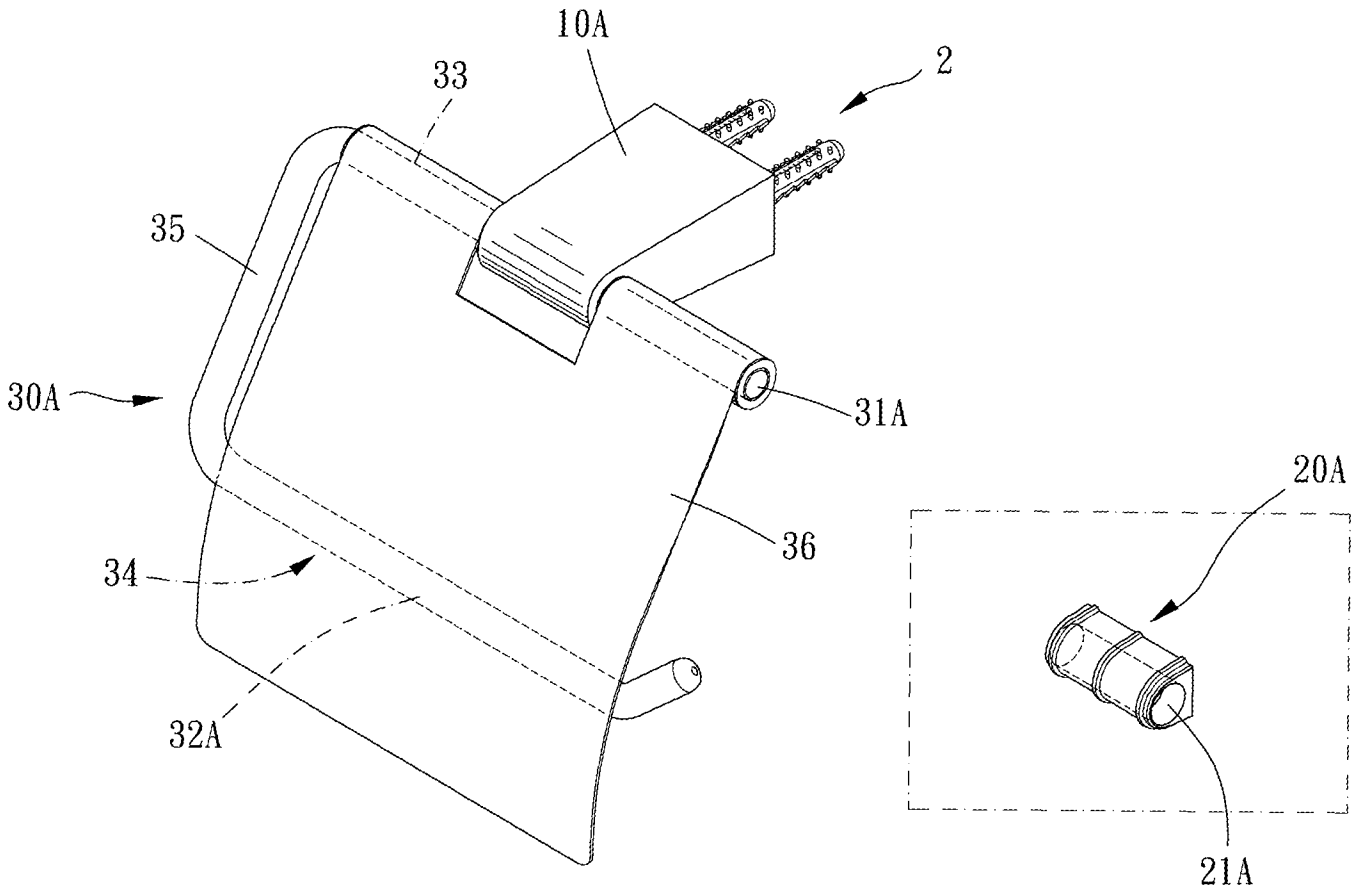
FIG. 4 is a stereogram of a second preferred embodiment of the present invention.

Please refer to FIGS. 2 and 4 for a second embodiment of a bathroom carrying device 2. Compared with the above-mentioned first embodiment, a metal shell member 10A of the bathroom carrying device 2 is formed with two through holes 13, and an inserting hole 21A goes through a plastic member 20A. The carrying member 30A is substantially C-shaped and has a first horizontal portion 33, a second horizontal portion 34 and a vertical portion 35 connected between the first horizontal portion 33 and the second horizontal portion 34. The first horizontal portion 33 having a disposing end 31A is disposed through the two through holes 13 and the inserting hole 21A. The second horizontal portion 34 is provided with a carrying portion 32A for placing toilet paper tolls, towels, clothes or other bathroom products. Preferably, the carrying member 30A further includes a plate 36. The plate 36 can be pivotally connected with the first horizontal portion 33 and extends away from the first horizontal portion 33; therefore, after the object was placed on the carrying portion 32A, the plate 36 will abut against the object to prevent the object from moving or falling.

Figure 5:
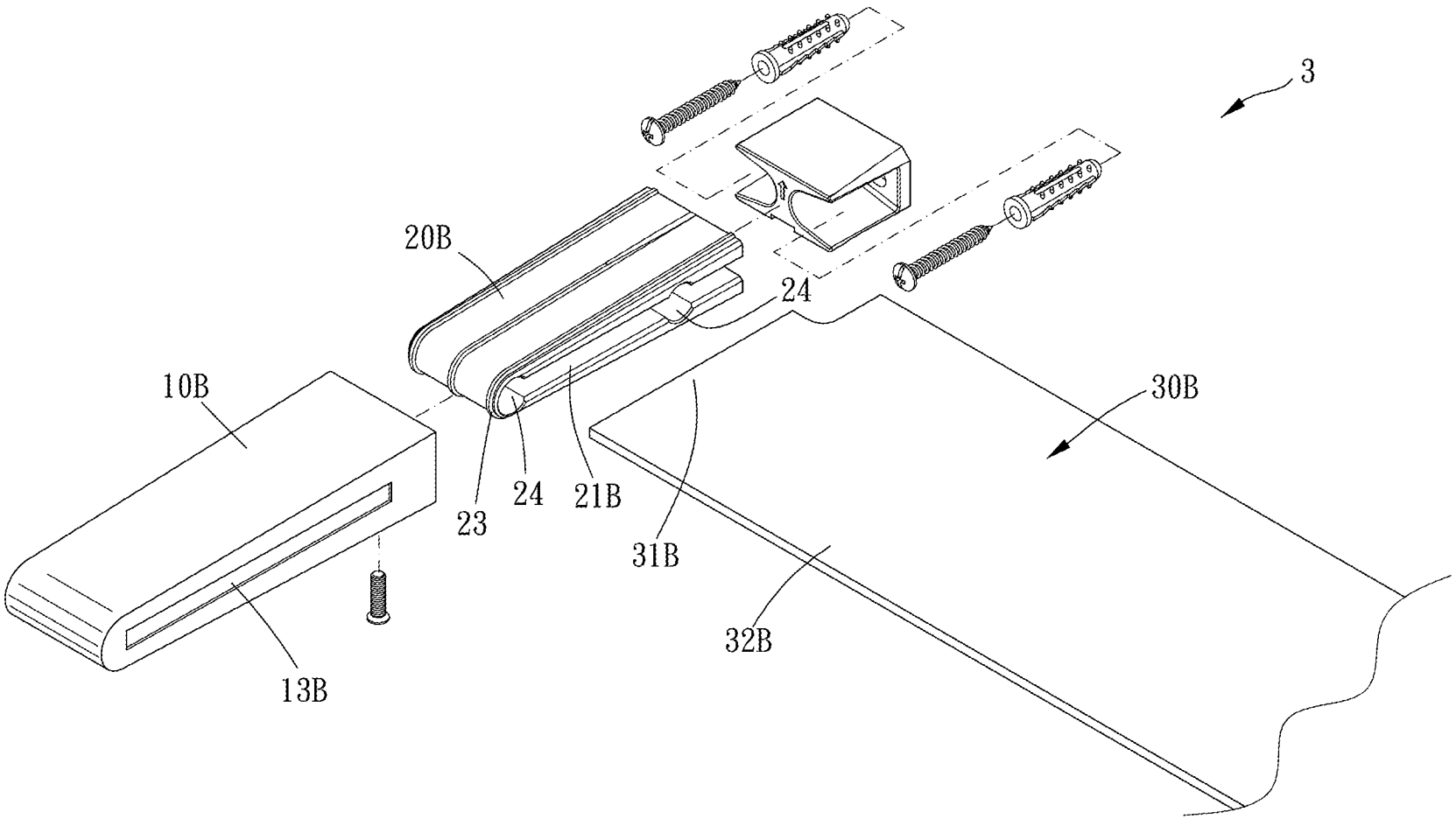
FIG. 5 is a breakdown drawing of a third preferred embodiment of the present invention.

Please refer to FIG. 5 for a third embodiment of a bathroom carrying device 3. Compared with the above-mentioned first embodiment, a through hole 13B of a metal shell member 10B and an inserting hole 21B of a plastic member 20B of the bathroom carrying device 3 are slit-shaped. The shape of a disposing end 31B of a carrying member 30B of the bathroom carrying device 3 is platy so as to cooperate with the shape of the through hole 13B and the inserting hole 21B. The disposing end 31B of the carrying member 30B is disposed through corresponding through hole 13B of the metal shell member 10B and into corresponding inserting hole 21B of the plastic member 20B. A carrying portion 32B of the carrying member 30B is a flat platform, which is provided for placing bottles or jars. In addition, in this embodiment, the inserting hole 21B is slit-shaped, and along the longitudinal direction an end of the plastic member 20B of the inserting hole 21B is formed with a thinned portion 23 so as to tightly clip on the disposing end 31B when the plastic member 20B is deformed. Furthermore, along the longitudinal direction the inserting hole 21B has one or a plurality of enlarged openings 24 (substantially round). The enlarged openings 24 can facilitate the elastic deformation of the plastic member 20B and the cooperation with another type of metal shell member.

Figure 6:
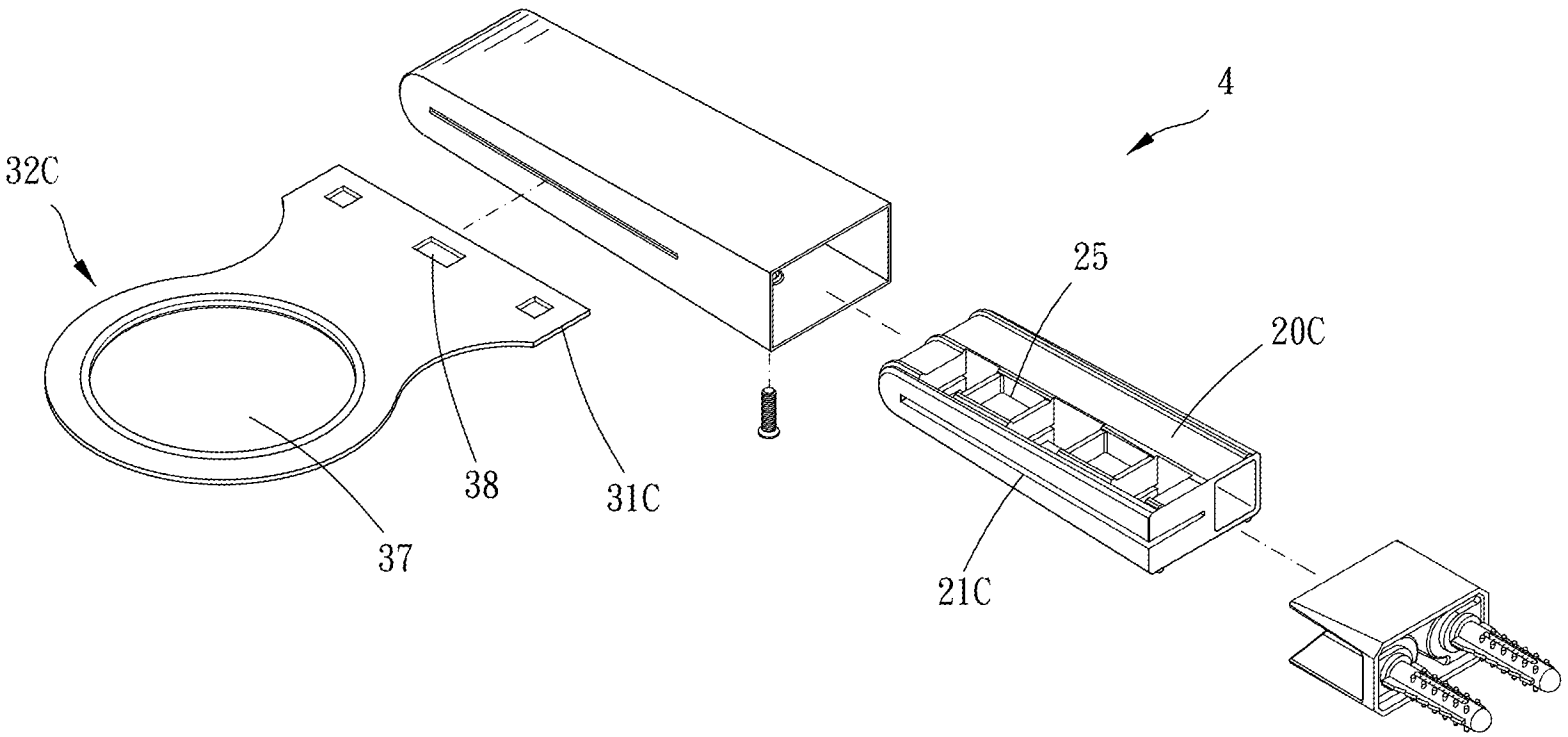
FIG. 6 is a breakdown drawing of a fourth preferred embodiment of the present invention.
Figure 7:
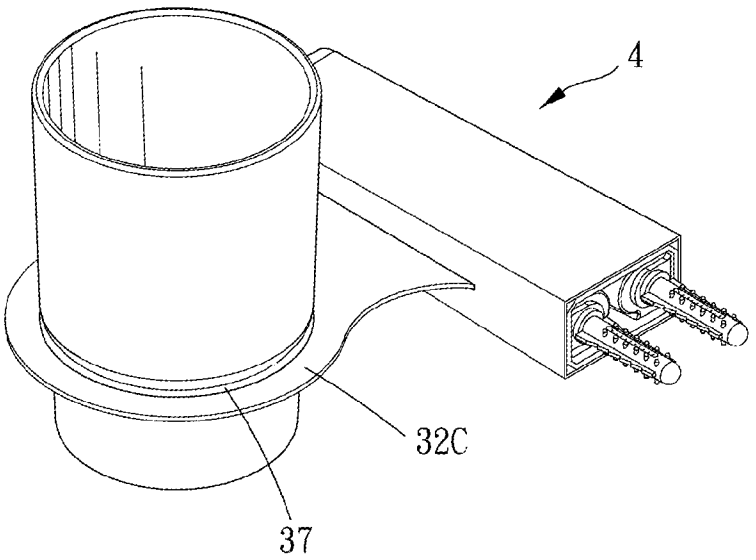
FIG. 7 is a stereogram of the fourth preferred embodiment of the present invention.

Please refer to FIGS. 6 and 7 for a fourth embodiment of the bathroom carrying device 4. Compared with the above-mentioned third embodiment, the carrying portion 32C of the bathroom carrying device 4 is formed with a receiving hole 37 (here it is an annular hole, and it can also be a C-shaped hole). The receiving hole 37 is provided for receiving cups, bottles, jars and other objects in column shape. Preferably, the plastic member 20C of the bathroom carrying device 4 is further formed with one or a plurality of lodging member 25. The disposing end 31C of the bathroom carrying device 4 is further formed with one or a plurality of lodging slot 38. Each lodging member 25 partly extends into corresponding inserting hole 21C and is restrictedly disposed in the lodging slot 38. Thereby, the connecting strength and stability of the disposing end 31C and the plastic member 20C is increased.

Figure 8:
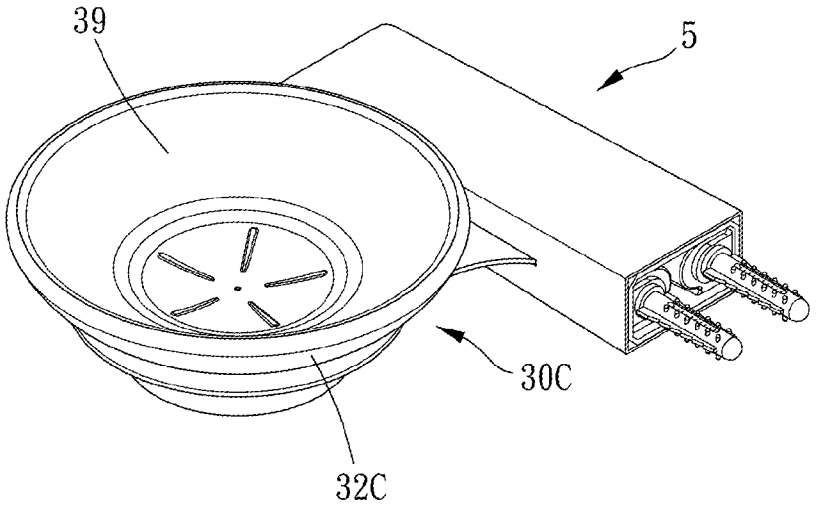
FIG. 8 is a stereogram of a fifth preferred embodiment of the present invention.

Please refer to FIGS. 6 and 8 for a fifth embodiment of a bathroom carrying device 5. Compared with the above-mentioned fourth embodiment, the carrying portion 32C of the carrying member 30C of the bathroom carrying device 5 is formed with a receiving recession 39. More specifically, the carrying member 30C further includes a receiving member which is substantially cone shape. The receiving member is disposed in the receiving hole 37. Understandably, the receiving member can be integrally disposed on the carrying member 30C and the receiving recession 39 is provided for placing soaps, aromatics, accessories, coins and other objects.

Figure 9:
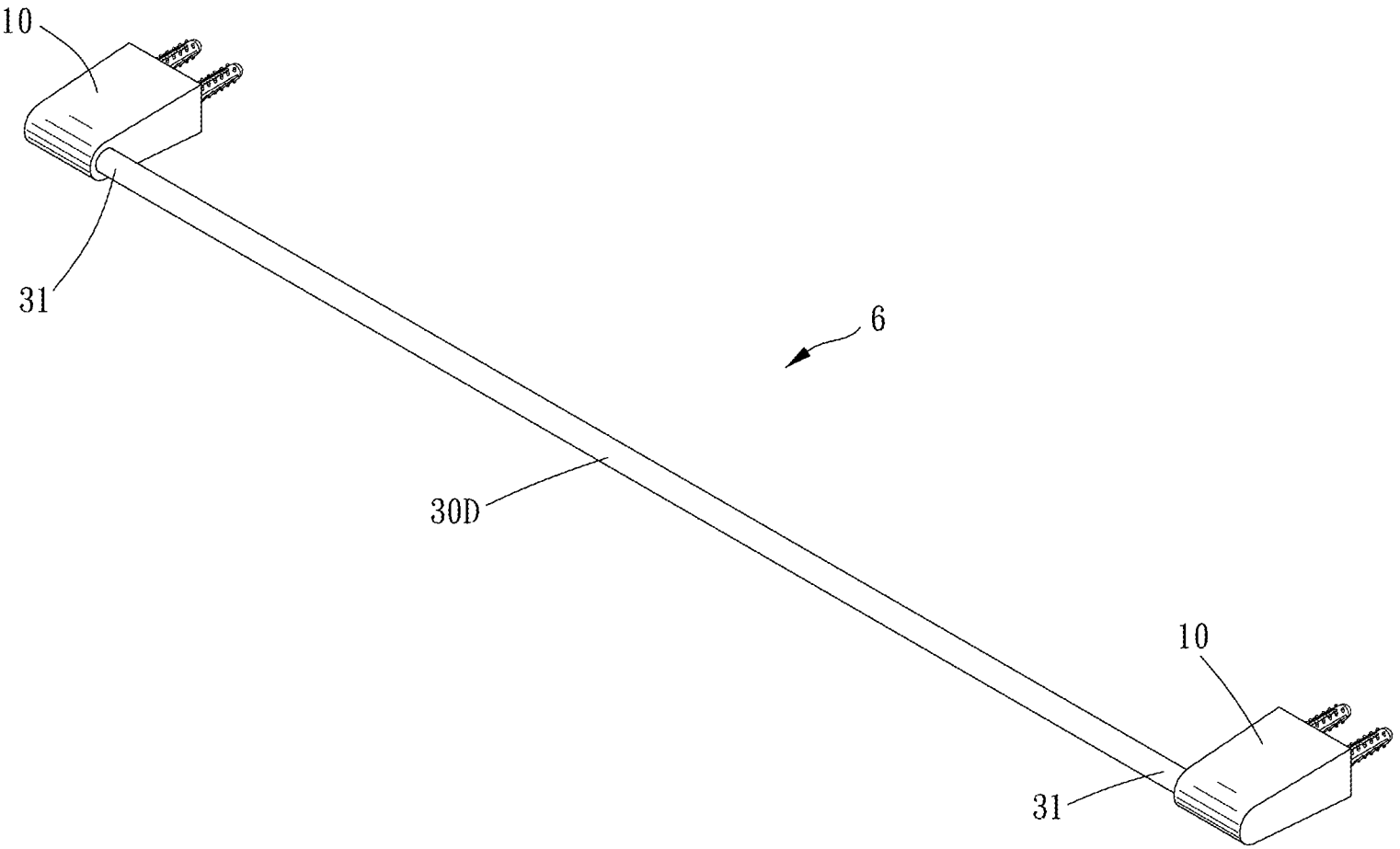
FIG. 9 is a stereogram of a sixth preferred embodiment of the present invention.

Please refer to FIGS. 2 and 9 for a sixth embodiment of a bathroom carrying device 6. Compared with the above-mentioned first embodiment, the carrying member 30D of the bathroom carrying device 6 is rod-shaped and has two disposing ends 31 facing each other. Each disposing end 31 is disposed at one end of the carrying member 30D. The bathroom carrying device 6 further includes two metal shell members 10 and two plastic members 20. Each disposing end 31 of the carrying member 30D is disposed through corresponding through hole 13 of the metal shell member 10 and into corresponding inserting hole 21 of the plastic member 20. Therefore, the carrying member 30D is traversed between the two metal shell members 10 and formed with a hanging space for hanging towels or clothes. Understandably, in other embodiments, the rod-shaped carrying member 30D can cooperate with only one of the metal shell members 10 and one of the plastic members 20. In other words, an end of the carrying member 30D can be fixedly disposed on the metal shell member 10 and the plastic member 20, and the other end extends out to form an open end for carrying objects.

Figure 10:
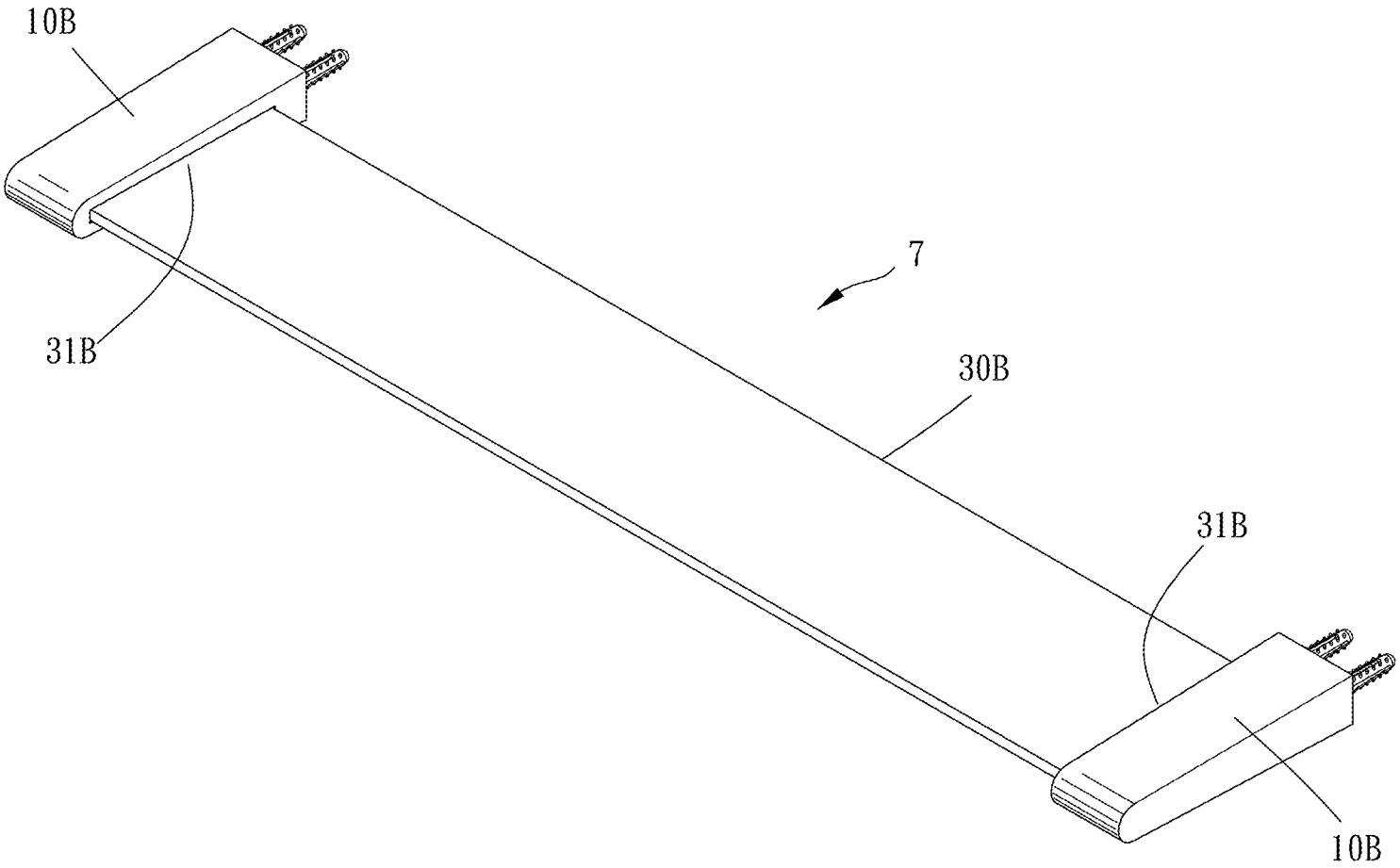
FIG. 10 is a stereogram of a seventh preferred embodiment of the present invention.

Please refer to FIGS. 5 and 10 for a seventh embodiment of a bathroom carrying device 7. Compared with the above-mentioned third embodiment, the bathroom carrying device 7 includes two metal shell members 10B, two plastic members 20B and a carrying member 30B. The carrying member 30B is platy and has two disposing ends 31B facing each other. Each disposing end 31B of the carrying member 30B is disposed through corresponding through hole 13B of the metal shell member 10B and into corresponding inserting hole 21B of the plastic member 20B. Therefore, the carrying member 30B is traversed between the two metal shell members 10B and formed with a flat platform for placing bottles or jars. Understandably, in other embodiments, the platy carrying member 30B can cooperate with only one of the metal shell members 10B and one of the plastic members 20B. In other words, one end of the carrying member 30B can be fixedly disposed on the metal shell member 10B and the plastic member 20B, and the other end extends out to form an open end for placing objects.

Figure 11:
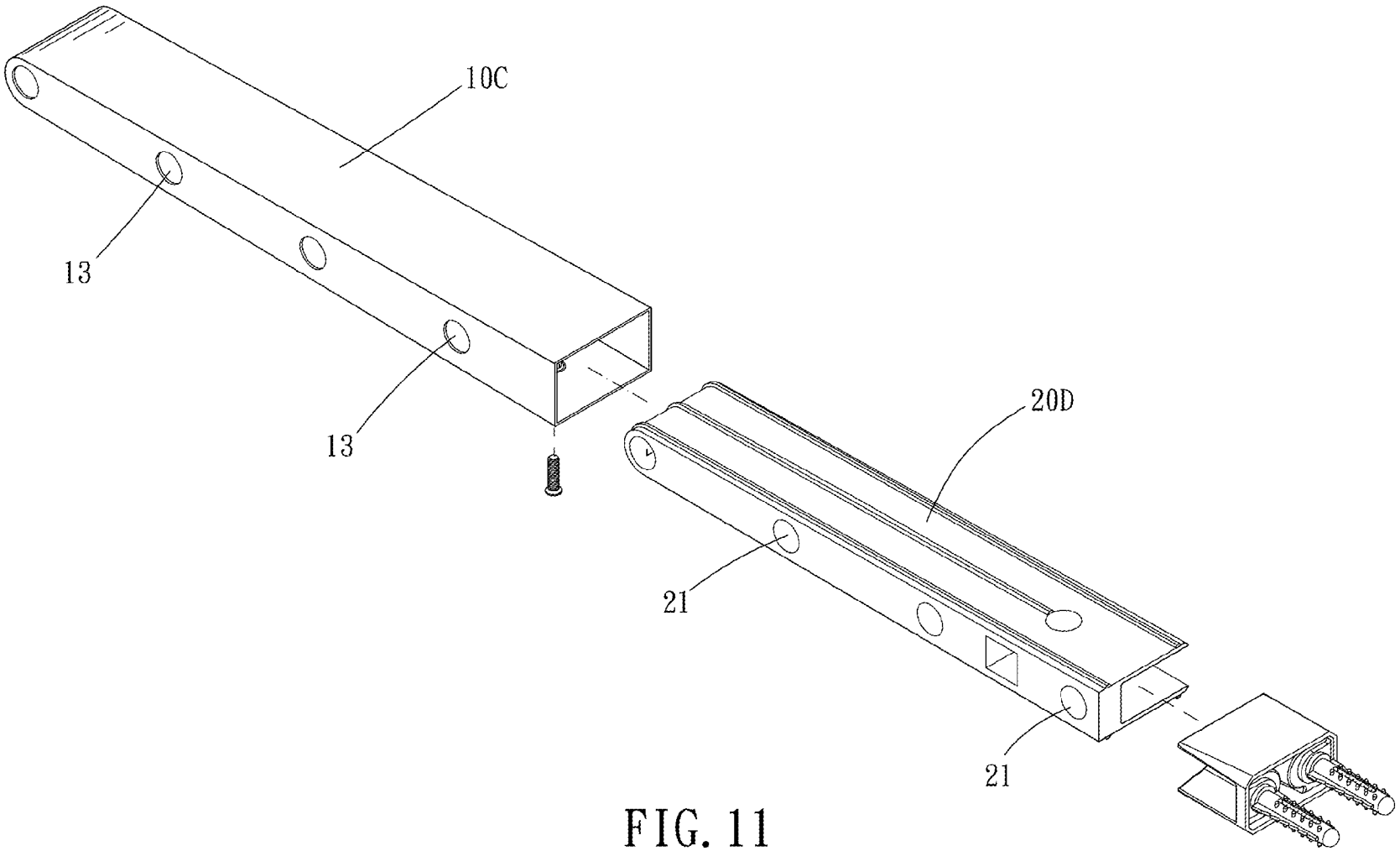
FIGS. 11 and 12 are sketches of an eighth preferred embodiment of the present invention.
Figure 12:
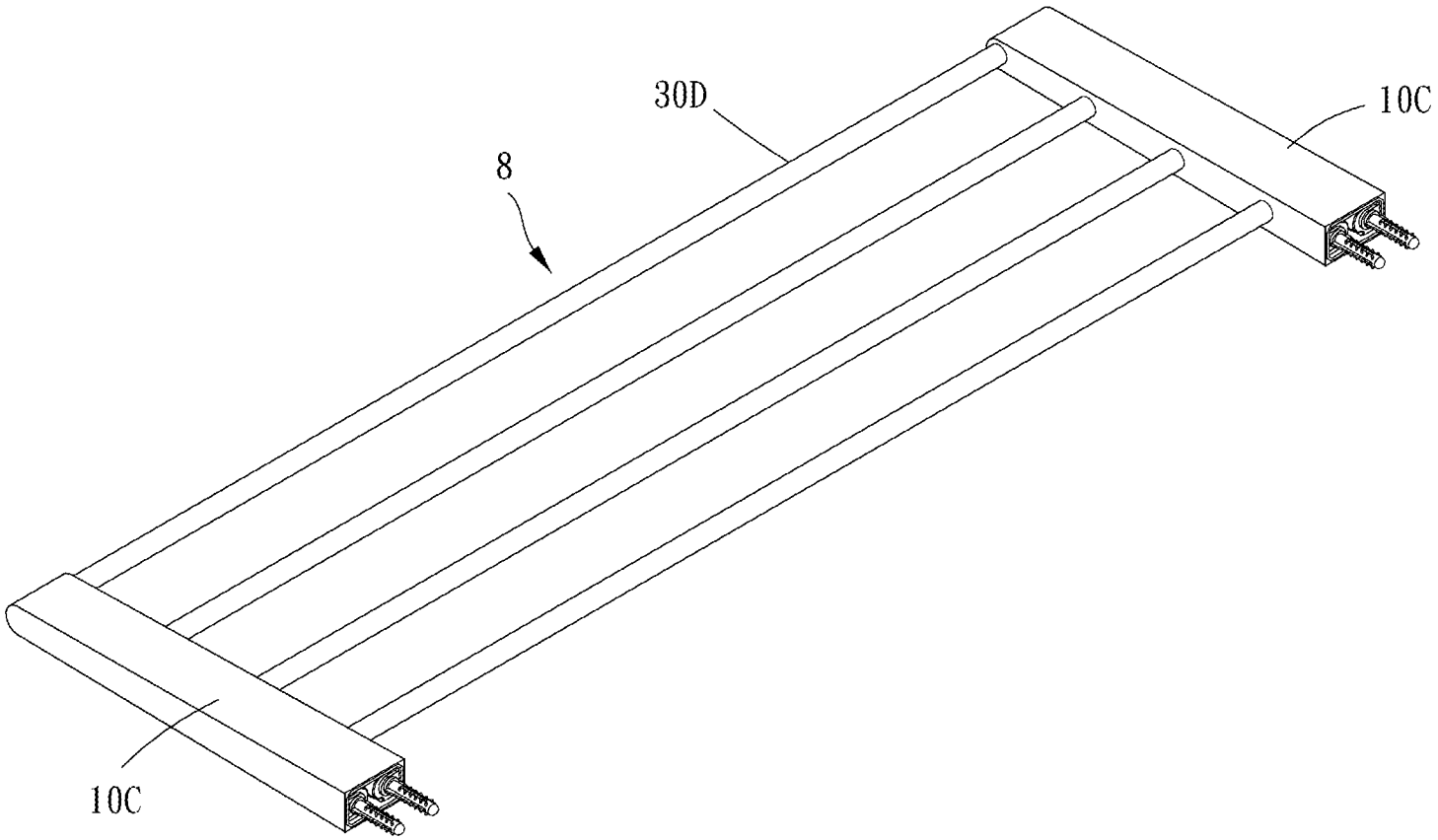

Please refer to FIGS. 11 and 12 for an eighth embodiment of a bathroom carrying device 8. Compared with the above-mentioned sixth embodiment, the bathroom carrying device 8 includes two the metal shell members 10C, two the plastic members 20D and a plurality of carrying members 30D. Each metal shell member 10C and each plastic member 20D are respectively formed with a plurality of corresponding through holes 13 and inserting holes 21 in intervals. Each disposing end 31 of the carrying member 30 is disposed through corresponding through hole 13 of the metal shell member 10C and into corresponding inserting hole 21 of the plastic member 20D. The carrying members 30D are substantially traversed between the two metal shell members 10C in parallel and formed with a plurality of hanging spaces for carrying objects. Understandably, in other embodiments, carrying members 30D can cooperate with only one of the metal shell members 10C and one of the plastic members 20D. In other words, an end of each carrying member 30D can be fixedly disposed on the metal shell member 10C and the plastic member 20D, and the other end extends out to form an open end for carrying objects.

The present invention further provides a bathroom hanging assembly which includes at least one of the above-mentioned bathroom carrying devices and further includes at least one mounting assembly 40. The following is the description based on the first embodiment of the bathroom carrying device 1. The mounting assembly 40 is mounted at a corresponding open end 12 of the metal shell member 10 for being fixedly attached to a base to form a structure for hanging, placing and receiving.

Given above, through the simple hollow metal shell member and the plastic member and carrying member with changeable structure, the bathroom carrying device and the bathroom hanging assembly having the same of the present invention can be mounted into hanging structures serving different functions.

In addition, the plastic member is made of plastic. Through different structural designs of the inserting hole of the plastic member, the plastic member can be restrictedly abutted against the metal shell member for the carrying member to mount thereon. The overall structure has great stability and strength.

Furthermore, the metal shell member of the present invention is hollow. It has simple structure and low weight, so it is easy to be manufactured and processed. It is low-cost and easy to be dismounted and mounted into different combinations.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A bathroom carrying device, including:

a metal shell member, surroundingly formed with an interior space, having an outer surface, provided with an open end, at least one through hole disposed to communicate the interior space and outside, the open end provided for mounting of a mounting assembly which can be fixedly attached to a base;

a plastic member, non-rotatably disposed in the interior space, having at least one inserting hole, the at least one inserting hole corresponding to the at least one through hole; and a carrying member, having at least one disposing end and a carrying portion, the at least one disposing end disposed through the at least one through hole and into the at least one inserting hole, the carrying portion being outside of the metal shell member and provided for carrying an object, wherein the interior space and the outer surface are flatly wedge-shaped and continuously linearly tapered from the open end toward an opposite end of the metal shell member, wherein the plastic member is wedge-shaped and continuously linearly tapered parallel to the interior space, the plastic member is formed with a plurality of protruding ribs, the protruding ribs extend in parallel to each other, each of protruding ribs extends from a lateral edge toward the opposite end of the metal shell member and reversely extends toward the open end to another lateral edge, and the protruding ribs are engageably abutted against the metal shell member.

2. The bathroom carrying device of claim 1, wherein the shape of the plastic member corresponds to that of a part of the interior space, and in a direction from the open end toward the opposite end of the metal shell member the plastic member is less ⅓ of the metal shell member in width.

3. The bathroom carrying device of claim 1, wherein the plastic member is deformably and restrictedly abutted against the metal shell member.

4. The bathroom carrying device of claim 1, wherein the shape of the at least one disposing end corresponds to that of the at least one inserting hole.

5. The bathroom carrying device of claim 1, wherein the metal shell member is formed with two of the through holes, the plastic member has two of the inserting holes, the carrying member is substantially C-shaped and has two of the disposing ends facing each other, and each disposing end is disposed through corresponding through hole and into corresponding inserting hole.

6. The bathroom carrying device of claim 1, wherein the carrying member is rod-shaped, and the disposing end is disposed at one end of the carrying member.

7. The bathroom carrying device of claim 1, wherein the bathroom carrying device includes two of the metal shell members, two of the plastic members and the carrying member, the carrying device is rod-shaped and has two of the disposing ends facing each other, each disposing end of the carrying member is disposed through corresponding through hole and into corresponding inserting hole.

8. The bathroom carrying device of claim 1, wherein the through hole and the inserting hole are slit-shaped, and the shape of the disposing end is platy.

9. The bathroom carrying device of claim 8, wherein the carrying portion is a flat platform.

10. The bathroom carrying device of claim 8, wherein the bathroom carrying device includes two of the metal shell members, two of the plastic members and one the carrying member, the carrying member is platy and has two of the disposing ends facing each other, each disposing end of the carrying member is disposed through corresponding through hole and into corresponding inserting hole.

11. The bathroom carrying device of claim 8, wherein the carrying portion is formed with a receiving recession.

12. The bathroom carrying device of claim 8, wherein the carrying portion is formed with a receiving hole.

13. The bathroom carrying device of claim 8, wherein along a longitudinal direction of the inserting hole an end of the plastic member is formed with a thinned portion.

14. The bathroom carrying device of claim 8, wherein the plastic member is further provided with at least one lodging member, the disposing end is further provided with at least one lodging slot, and at least one part of the lodging member stretches into the inserting hole and restrictedly disposed in the lodging slot.

15. The bathroom carrying device of claim 1, wherein along the longitudinal direction the inserting hole is slit-shaped and formed with at least one enlarged opening which is cylindrical and adapted for restrainingly receiving a rod member, and one of the at least one enlarged opening is provided at an end near the opposite end of the metal shell.

16. The bathroom carrying device of claim 1, wherein the metal shell device is formed with two of the through holes, the inserting hole goes through the plastic member, the carrying member is substantially C-shaped and has a first horizontal portion, a second horizontal portion and a vertical portion connecting the first horizontal portion and the second horizontal portion, the first horizontal portion is formed with the disposing end and disposed through the two through holes and the inserting hole, and the second horizontal portion is provided with the carrying portion for the object to dispose therearound.

17. The bathroom carrying device of claim 16, wherein the carrying member further includes a plate, the plate is pivotally connected with the first horizontal portion and extends away from the first horizontal portion.

18. A bathroom hanging assembly, including one of the bathroom carrying device of claim 1, further including:

at least one mounting assembly, mounted at the open end of corresponding metal shell member, provided for being fixedly attached to a base.

* * * * *